US006969283B2

(12) United States Patent
Schmidt

(10) Patent No.: US 6,969,283 B2
(45) Date of Patent: Nov. 29, 2005

(54) DEVICE FOR MOUNTING A CONNECTOR CONTACT INSERT IN A CONNECTOR HOUSING

(75) Inventor: Martin Schmidt, Lübbecke (DE)

(73) Assignee: Harting Electric GmbH & Co. KG, (DE)

( * ) Notice: Subject to any disclaimer, the term of this patent is extended or adjusted under 35 U.S.C. 154(b) by 103 days.

(21) Appl. No.: 10/751,604

(22) Filed: Jan. 5, 2004

(65) Prior Publication Data

US 2004/0152364 A1 Aug. 5, 2004

(30) Foreign Application Priority Data

Jan. 31, 2003 (DE) ..... 103 03 800

(51) Int. Cl.[7] ..... H01R 13/502
(52) U.S. Cl. ..... 439/687
(58) Field of Search ..... 439/687, 607, 439/629, 610

(56) References Cited

U.S. PATENT DOCUMENTS 5,562,497 A * 10/1996 Yagi et al. ..... 439/610
5,820,412 A * 10/1998 Koegel et al. ..... 439/610
5,831,815 A * 11/1998 Miller et al. ..... 361/679
5,836,774 A * 11/1998 Tan et al. ..... 439/76.1
5,899,772 A * 5/1999 Beaver et al. ..... 439/610
6,017,245 A * 1/2000 Karir ..... 439/610
6,146,205 A * 11/2000 Lai ..... 439/610
6,210,229 B1 * 4/2001 Lai ..... 439/610
6,213,814 B1 * 4/2001 Kuo et al. ..... 439/607
6,247,978 B1 * 6/2001 Wu ..... 439/879
6,328,588 B1 * 12/2001 Tsai et al. ..... 439/352
6,688,903 B2 * 2/2004 Kakinoki et al. ..... 439/362
6,705,894 B1 * 3/2004 Comerci et al. ..... 439/607

FOREIGN PATENT DOCUMENTS

DE 3313144 4/1983 ..... H01R 13/512
DE 9408909.4 5/1994 ..... H01R 13/73
DE 29618550 10/1996 ..... H01R 13/658
EP 0125498 6/1987 ..... H01R 13/502
GB 2285184 5/1995 ..... H01R 13/621

* cited by examiner

*Primary Examiner*—Ross Gushi
(74) *Attorney, Agent, or Firm*—Hayes Soloway P.C.

(57) ABSTRACT

In order to fix a connector contact insert that is provided with sheet metal flanges in a connector housing that is composed of two interconnectable rectangular shells, the invention proposes a mounting device that is respectively arranged in the corner regions of the shells. The device respectively comprises two integral elements that are spaced apart from one another and form a receptacle slot, wherein differently shaped spring elements can, depending on the respective application, be pushed onto said integral elements or fixed on the shell housing. When assembling the connector, the sheet metal flanges are inserted into the receptacle slots and the two shells are interconnected, wherein the spring elements ensure a shakeproof mounting of the connector contact insert in the connector housing.

6 Claims, 5 Drawing Sheets

DEVICE FOR MOUNTING A CONNECTOR CONTACT INSERT IN A CONNECTOR HOUSING

Figure 1:
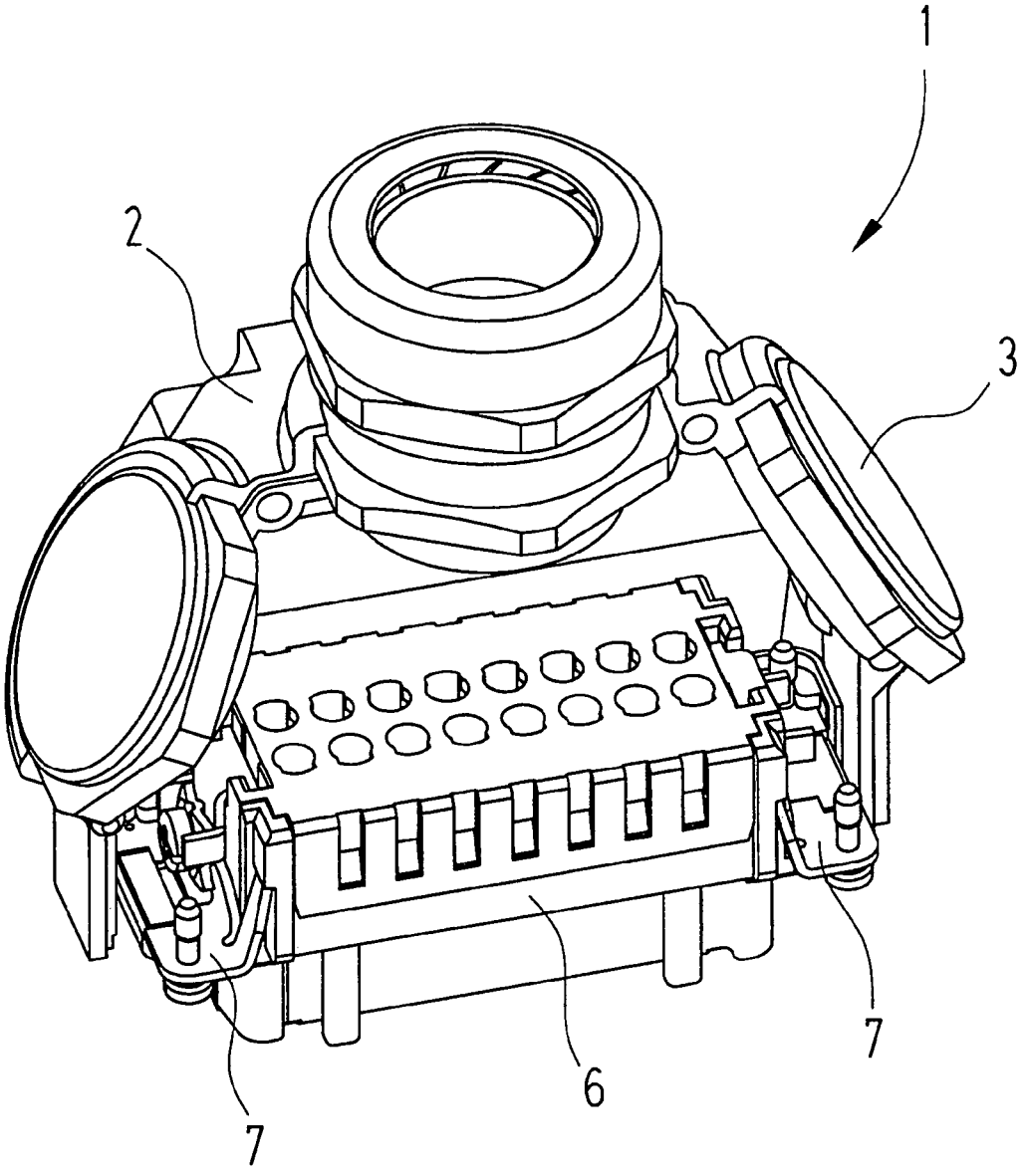

The invention pertains to a device for mounting and contacting a connector contact insert with at least one sheet metal flange in an electrically conductive connector housing that is composed of two rectangular interconnectable shells.

A device of this type is required for mounting an electrically conductive flange, in which a connector contact insert is held, in a connector housing, as well as for ensuring an electrically conductive connection between the flange and the housing and for conforming to VDE safety guidelines.

In similarly designed connector housings, a connector contact insert is held in a sheet metal flange and mounted by means of screws that are screwed into corresponding eyelets integrally formed onto the corner regions of the connector housing. However, it is always required to carry out installation procedures that are only completed once the connector body is screwed together.

The invention is based on the objective of additionally developing a device of the initially described type in such a way that a connector contact insert held in a sheet metal flange can be fixed in a connector housing that is composed of two interconnectable shells without additional mounting means.

This objective is attained due to the fact that two elements respectively are integrally formed onto the inner corner regions of the shells such that the sheet metal flanges can be inserted between these integral elements, and due to the fact that electrically conductive spring elements for acting upon the sheet metal flanges are arranged in the corner regions and connected to the shells, wherein the connector contact insert is fixed in position after the shells are interconnected.

Advantageous embodiments of the invention are disclosed in Claims 2–6.

Connectors usually consist of a connector housing with one or more cable lead-throughs and at least one connector contact insert that is mounted in the housing. The connector contact insert may be held within the housing by means of different mounting methods. In one such method, angled sheet metal flanges are arranged on the narrow sides of a connector contact insert manufactured of insulating material, wherein four screws that are held in a captive fashion are provided on the corners of the sheet metal flanges in order to fix the connector contact insert in the connector housing by screwing said screws into corresponding threaded eyelets that are integrally formed onto the housing. The advantage of the invention can be seen in the fact that known connector contact inserts of this type can be fixed in the connector housing without the utilization of a tool. The device according to the invention is composed of simple integral elements that protrude from the wall of a connector housing consisting of two halves, as well as of different sheet metal parts that are shaped into spring elements. Two integral elements that are spaced apart from one another respectively form a receptacle slot, wherein a pair of integral elements is provided in each corner region of the connector housing.

Spring elements in the form of differently shaped sheet metal parts may be snapped into or rigidly connected to the housing on or between these integral elements. The holding elements comprise at least one spring element that advantageously presses the sheet metal flanges inserted into the receptacle slots against one of the integral elements, wherein the at least one spring element securely fixes the sheet metal flange in position when the housing shells are interconnected and simultaneously ensures an electric contact between the sheet metal flange and the housing. In this case, it is also advantageous that sheet metal flanges with two defined but different sheet metal thicknesses can be inserted into the receptacle slots and fixed therein. In one variation, the mounting device can only accommodate a sheet metal flange with a certain thickness.

Figure 2:
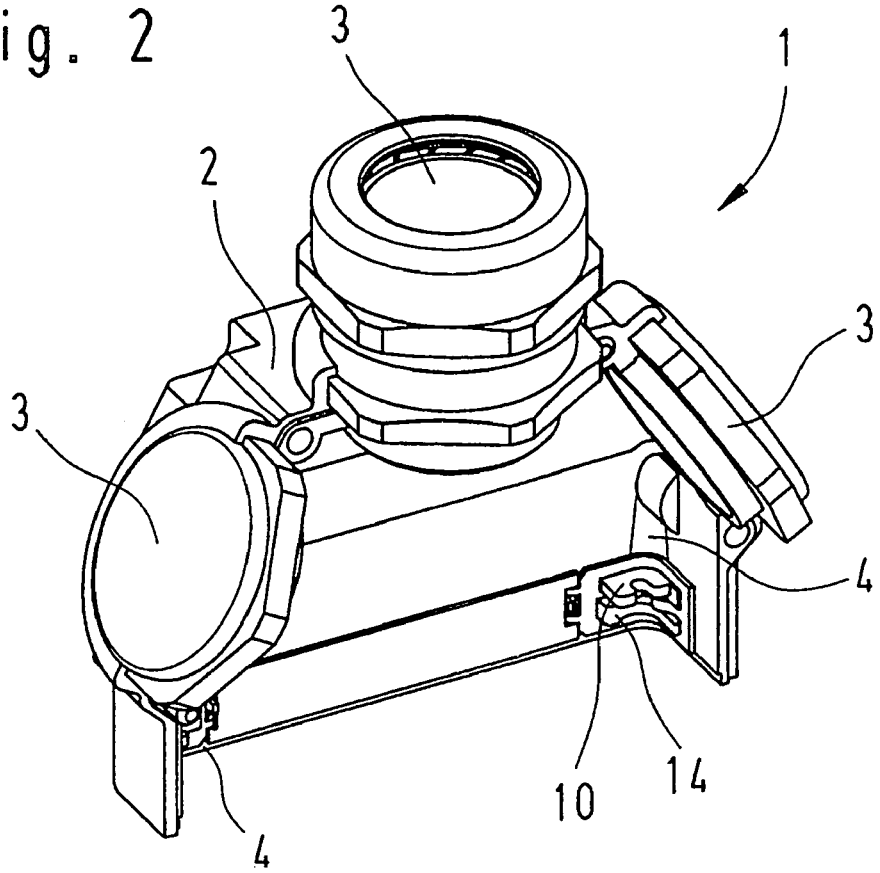
Figure 3:
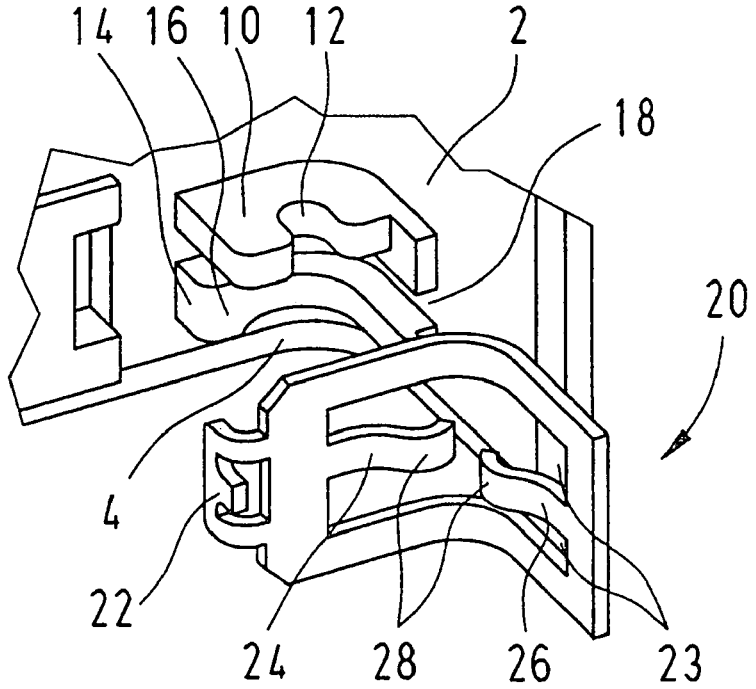
Figure 4:
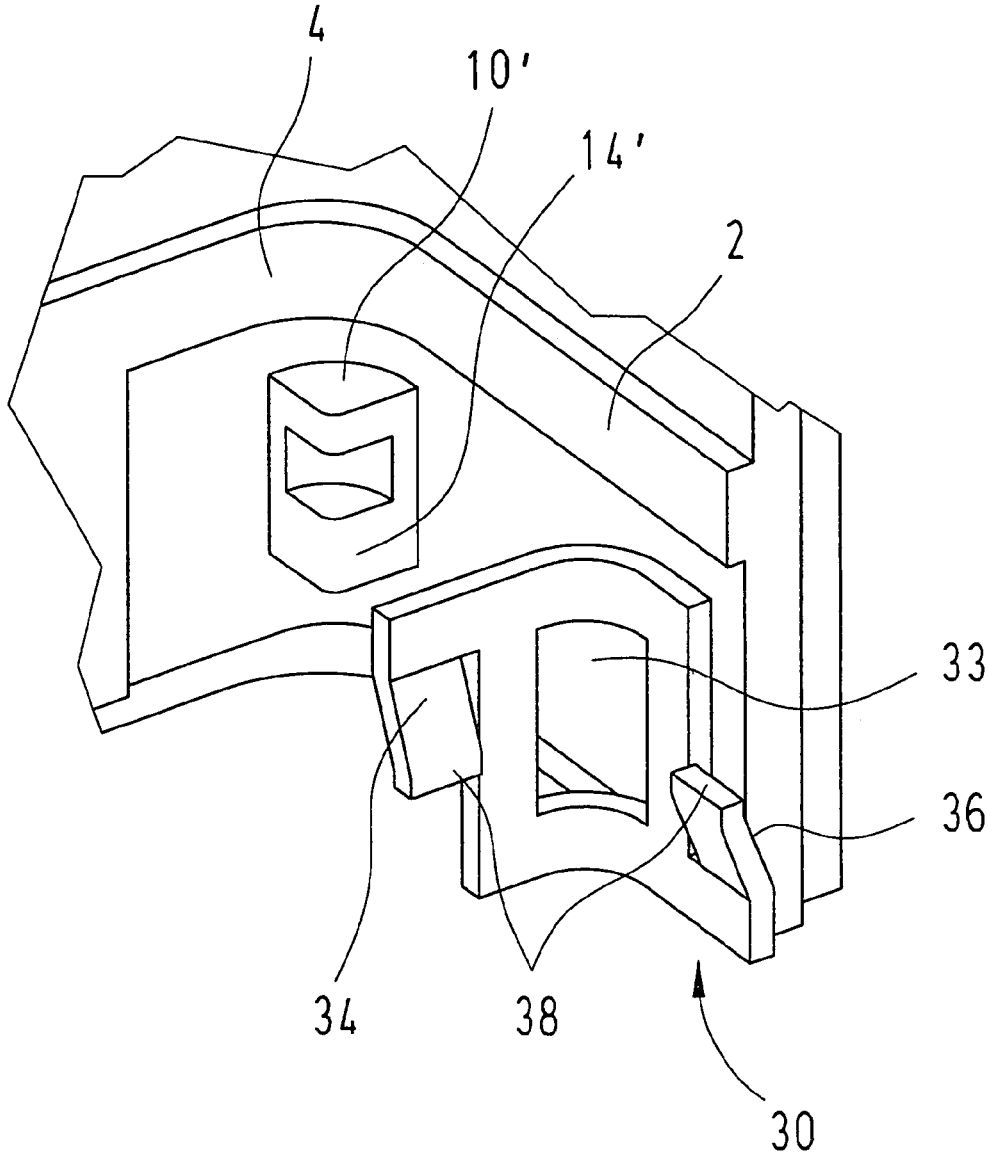
Figure 5:
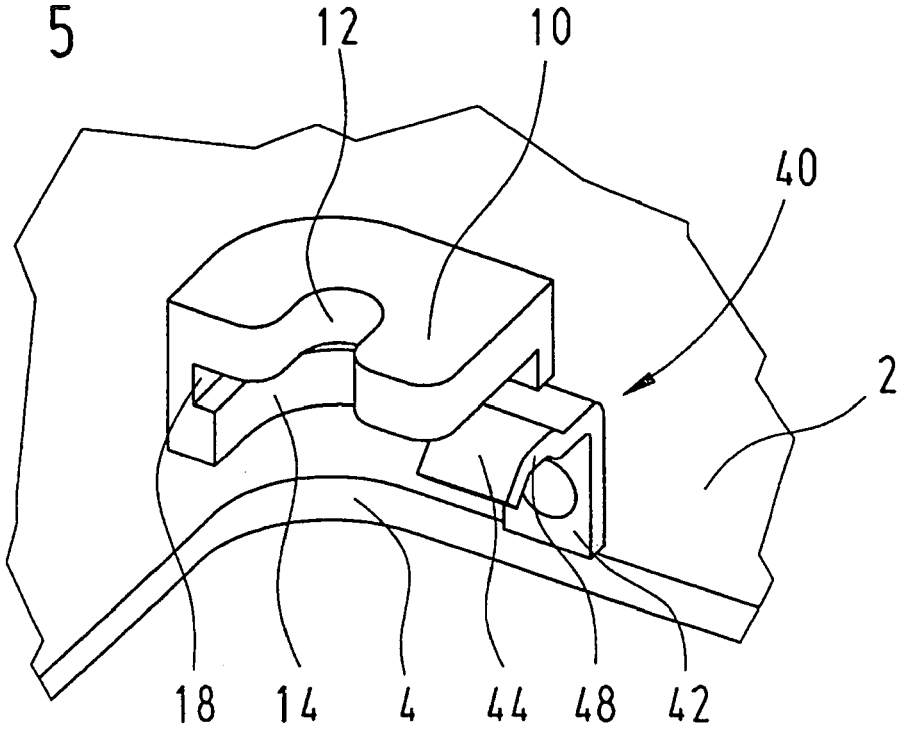
Figure 6:
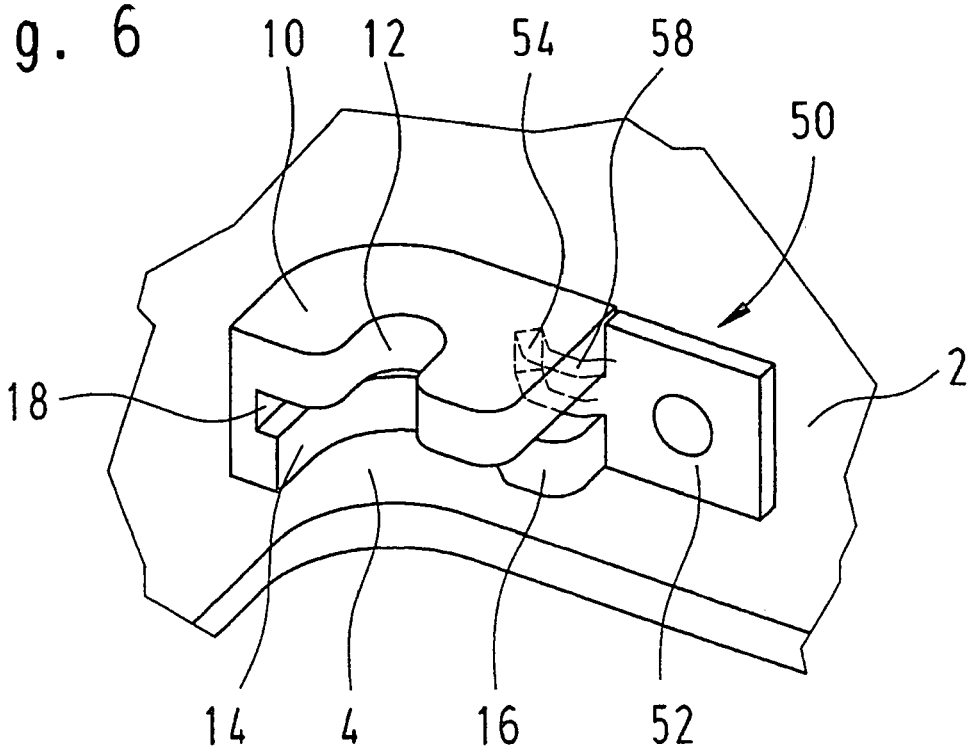
Figure 7:
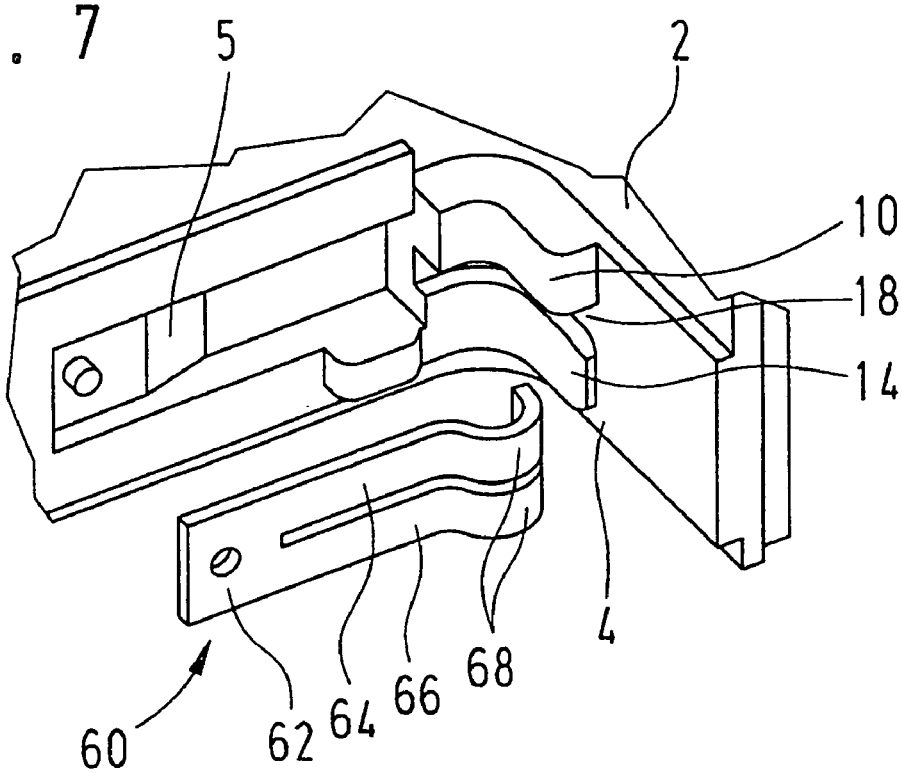

One embodiment of the invention is illustrated in the figures and described in greater detail below. The figures show:

FIG. 1, a shell housing with a connector contact insert;

FIG. 2, a shell housing, in the corner regions of which a device for mounting a connector contact insert is arranged;

FIG. 3, an enlarged representation of the device with an angled spring element;

FIG. 4, a variation of the angled spring element;

FIG. 5, another variation with an angled spring element;

FIG. 6, a variation with a flat, short spring element;

FIG. 7, a variation with a flat, long spring element, and

Figure 8:
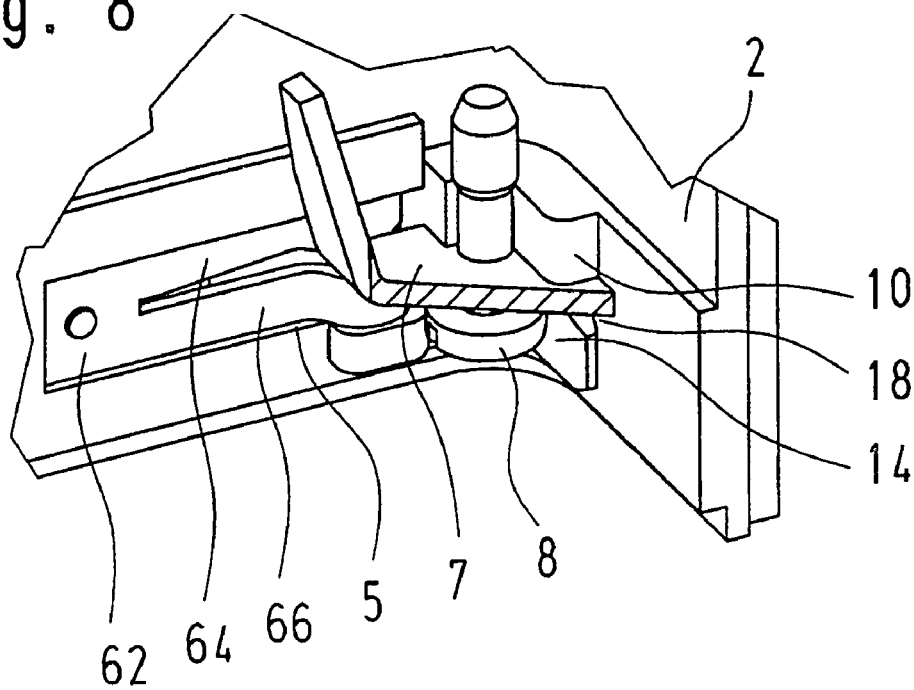

FIG. 8, a functional representation of the device.

FIG. 1 shows a connector housing 1 that is composed of two shells in the assembled state, wherein the front shell is removed in the housing shown. A connector contact insert 6 that is held in the connector housing by means of angled sheet metal flanges 7 and the described device is illustrated in the rear shell 2.

FIG. 2 shows a perspective representation of the shell 2 of the connector housing which contains three cable lead-throughs 3. A device for mounting the connector contact insert is shown in the inner corner region 4. The device is composed of two integral elements 10, 14 that protrude from the housing wall of the shell, as well as of a spring element that may have different shapes.

Such a spring element is illustrated in an enlarged fashion in FIG. 3 and essentially consists of a frame-like sheet metal part 20 that is angled by approximately 90°, wherein two spring arms 24, 26 that are provided with curved spring ends 28 and point to the corner region are cut out of said sheet metal part along three sides. The housing shell 2 is provided with two integral elements 10, 14, onto which the sheet metal part 20 can be pushed such that the integral elements penetrate into the recesses 23 between the frame and the spring arms and ultimately protrude therefrom. A snap-on mechanism 22 that is not described in greater detail holds the sheet metal part 20 on the housing shell 2. The spacing between the integral elements 10, 14 forms a slot 18, into which the sheet metal flange 7 of the connector contact insert can be pushed.

The width of the slot 18 in connection with the spring arms 24, 26 makes it possible to accommodate two different sheet metal thicknesses. For this purpose, the spring arms are positioned in the frame of the sheet metal part in a slightly offset fashion at different heights, namely such that the spring arm 24 drawn on the left is arranged in the upper region of the frame-like sheet metal part 20 and the right spring arm 26 is arranged in the lower region. When inserting a sheet metal flange with the maximum thickness into the slot 18, the curved spring ends 28 of both spring elements are pressed against the outer edges of the sheet metal flange. When inserting a sheet metal part with a smaller but specified thickness into the slot, the lower spring arm 26 slides underneath the sheet metal flange and presses the sheet metal flange against the upper integral element 10 with its narrow side while the spring end of the upper spring arm 24 presses against the outer edge of the sheet metal flange (in this respect, see also FIG. 8).

Since sheet metal flanges with screws on their outer corners are mounted on the connector contact insert in order to tightly screw the sheet metal flanges to the connector housing, the upper integral element 10 is provided with an indentation 12, into which such a screw merely protrudes when the sheet metal flange is inserted into the receptacle slot 18. In comparison with the upper integral element, the lower integral element 14 is smaller and realized with a rounded projection 16. Once the two shells are ultimately screwed together, the connector contact insert is rigidly held in the devices of the connector housing.

FIG. 4 shows a variation of the spring element according to FIG. 3 which also comprises a bent sheet metal part 30. In this case, the spring arms 34, 36 are arranged on the outer edges of both sheet metal limbs, namely such that they are vertically cut out of the sheet material as shown in the figure. The spring ends 38 are slightly curved and act in the interior of the shell.

The sheet metal part 30 is also pushed onto slightly modified integral elements 10', 14' of the housing wall and fixed thereon.

FIG. 5 shows another variation of a spring element in the form of an angled sheet metal part 40 that contains a mounting section 42 and an angled spring arm 44 with a curved spring end 48. In this case, the sheet metal part is not fixed on the housing wall of the shell by means of the partially shortened lower integral element 14, but rather underneath the integral element 10 such that the curved spring end 48 is directed toward the integral element 10 and presses a sheet metal flange situated in between against the integral element. However, this variation only makes it possible to accommodate a sheet metal flange with a certain thickness.

FIG. 6 shows a spring element that is realized in the form of a flat sheet metal part 50 and contains a mounting section 52 and a spring arm 54 with a curved spring end 58. The spring arm of the sheet metal part 50 is positioned in the receptacle slot 18 between the two integral elements 10, 14 such that the spring effect is directed toward the outer flange edge of a sheet metal flange inserted into the receptacle slot. The mounting section 52 of the sheet metal part 50 is mounted on the housing wall. However, this variation only makes it possible to accommodate a sheet metal flange with a certain thickness.

FIG. 7 also shows a spring element in the form of a flat sheet metal part 60. The long spring travel of the spring arms 64, 66 that are situated adjacent to the mounting section 62 and provided with curved spring ends 68 makes it possible to insert a sheet metal flange relatively gently. The sheet metal part 60 is inserted into a recess 5 in the housing wall and fixed in position by means of rivets, namely such that the curvature of the spring ends 68 points into the interior. This double arrangement of the spring arms also makes it possible to insert sheet metal flanges with two different thicknesses into the receptacle slot 18 as already described above with reference to FIG. 3.

FIG. 8 shows the corner region 4 of the shell 2 according to FIG. 7. This figure shows a mounting device with a mounted sheet metal flange 7 in order to elucidate the function of the device. A thin sheet metal flange 7 with a mounting screw 8 is inserted into the receptacle slot 18 between the two integral elements 10, 14. The sheet metal flange contacts the underside of the upper integral element 10, wherein the sheet metal flange remains spaced apart from the lower integral element 14. This spacing is realized with the lower spring arm 66 that is positioned underneath the sheet metal flange. The upper spring arm 64 is pressed into the recess 5 by the edge of the sheet metal flange. This means that the sheet metal flange can be mounted and fixed in the connector housing without tools, namely while simultaneously realizing the electrical contacting. If a sheet metal flange with a thickness that fills out the receptacle slot 18 is inserted, both spring arms 64, 66 are pressed into the recess 5, and both spring arms press against the edge of the sheet metal flange with the curved spring ends 68.

What is claimed is:

1. A device for mounting and contacting a connector contact insert (6) with at least one sheet metal flange (7) in an electrically conductive connector housing that is composed of two rectangular interconnectable shells (2), characterized in that two elements (10, 14) respectively are integrally formed onto the inner corner regions of the shells (2) such that the sheet metal flanges (7) can be inserted between said elements, and in that electrically conductive spring elements for acting upon the sheet metal flanges are arranged in the corner regions and connected to the shells, wherein the connector contact insert (6) is fixed in position after the shells are interconnected.

2. The device according to claim 1, characterized in that the spring element is realized in the form of a bent sheet metal part (20) and contains spring arms (24, 26) that are cut out on three sides and provided with curved spring ends (28) that point to the corner region, and in that the sheet metal part (20) contains recesses (23) that make it possible to push the sheet metal part onto the integral elements (10, 14).

3. The device according to claim 1, characterized in that the spring element is realized in the form of an angled sheet metal part (30), wherein one respective spring arm (34, 36) with a curved spring end (38) is cut out of the lateral limb ends of the sheet metal part in the inserting direction of the sheet metal flanges (7) of the connector contact insert, and in that the sheet metal part (30) contains a recess (33) that makes it possible to push the sheet metal part onto the integral elements (10', 14') in the corner regions of the shell.

4. The device according to claim 1, characterized in that the spring element is realized in the form of an angled sheet metal part (40), wherein one limb is realized in the form of a mounting section (42) and the other limb is realized in the form of a spring arm (44) with a curved spring end (48), and in that the mounting section (42) of the sheet metal part (40) is mounted on the shell underneath the integral element (10), wherein the curved spring end (48) of the spring arm points in the direction of the integral element (10) that protrudes from the housing wall.

5. The device according to claim 1, characterized in that the spring element is realized in the form of a flat sheet metal part (50) and contains a mounting section (52) and a spring arm (54) with a curved spring end (58), and in that the mounting section (52) of the sheet metal part is fixed on the wall of the shell, wherein the spring arm (54) is positioned between the integral elements (10, 14).

6. The device according to claim 1, characterized in that the spring element is realized in the form of a flat sheet metal part (60) and contains a mounting section (62) and two spring arms (64, 66) with curved spring ends (68), and in that the sheet metal part is mounted in a recess (5) in the corner region of the interior of the shell (2).

* * * * *